US006310437B1

(12) United States Patent
Blau et al.

(10) Patent No.: US 6,310,437 B1
(45) Date of Patent: Oct. 30, 2001

(54) FLUORESCENT LAMP EXTENSION TUBE AMALGAM HOLDER

(75) Inventors: Andrew P. Blau, Richmond Hts.; William W. Akins, Aurora, both of OH (US); Joseph C. Borowiec, Schenectady, NY (US); Sandor Lukacs, Veroce (HU)

(73) Assignee: General Electric Company, Schenectady, NY (US)

( * ) Notice: Subject to any disclaimer, the term of this patent is extended or adjusted under 35 U.S.C. 154(b) by 12 days.

(21) Appl. No.: 09/584,948

(22) Filed: Jun. 1, 2000

(51) Int. Cl.[7] ..... H01J 61/24

(52) U.S. Cl. ..... 313/552; 313/564; 313/565; 313/490

(58) Field of Search ..... 313/550, 551, 313/552, 562, 564, 565, 490

(56) References Cited

U.S. PATENT DOCUMENTS

| | | | |
|---|---|---|---|
| 3,422,299 | | 1/1969 | Morehead . |
| 3,504,215 | | 3/1970 | Evans . |
| 3,526,802 | | 9/1970 | Wainio . |
| 3,526,804 | | 9/1970 | Evans et al. . |
| 3,562,571 | | 2/1971 | Evans et al. . |
| 3,591,828 | | 7/1971 | Washimi et al. . |
| 3,614,506 | | 10/1971 | Evans . |
| 3,619,697 | | 11/1971 | Evans . |
| 3,634,717 | | 1/1972 | Boucher et al. . |
| 3,713,201 | | 1/1973 | Evans . |
| 3,890,531 | | 6/1975 | Panofski et al. . |
| 3,898,720 | | 8/1975 | Morehead . |
| 3,906,284 | | 9/1975 | Franck et al. . |
| 4,015,162 | | 3/1977 | Evans et al. . |
| 4,020,378 | | 4/1977 | Morehead . |
| 4,047,071 | | 9/1977 | Busch et al. . |
| 4,145,634 | | 3/1979 | Evans et al. . |
| 4,288,715 | * | 9/1981 | Van Overveld ..... 313/490 |
| 4,794,301 | | 12/1988 | Misono et al. . |
| 5,394,056 | * | 2/1995 | Forman et al. ..... 313/490 |
| 5,412,288 | | 5/1995 | Borowiec et al. . |
| 5,412,289 | | 5/1995 | Thomas et al. . |
| 5,434,482 | | 7/1995 | Borowiec et al. . |
| 5,598,069 | | 1/1997 | van Os et al. . |
| 5,629,584 | | 5/1997 | Borowiec et al. . |
| 5,739,633 | | 4/1998 | Biro et al. . |
| 5,767,617 | | 6/1998 | Wharmby et al. . |
| 5,798,618 | | 8/1998 | van Os et al. . |
| 5,828,169 | | 10/1998 | Myojo et al. . |
| 5,841,229 | | 11/1998 | Borowiec et al. . |
| 5,847,508 | | 12/1998 | Borowiec et al. . |
| 5,909,085 | | 6/1999 | Nelson . |

* cited by examiner

*Primary Examiner*—Michael H. Day
(74) *Attorney, Agent, or Firm*—Pearne & Gordon LLP

(57) ABSTRACT

A glass extension (24) with a cavity (32) for an amalgam (22) is added to an exhaust tube (12) or a flare (14) of a fluorescent lamp. The mouth (36) of the cavity (32) is provided with a bimetal valve having a cover portion (40) to close the cavity (32) when the lamp is cold and to open the cavity when the lamp is hot. The amalgam (22) is a metallic amalgam of, for example, mercury or other know suitable materials for establishing a metallic vapor equilibrium during operation of a discharge lamp. The amalgam holder helps to maintain optimum mercury vapor equilibrium at start-up, and to reduce the effects of mercury vapor starvation resulting from off-times.

6 Claims, 4 Drawing Sheets

FLUORESCENT LAMP EXTENSION TUBE AMALGAM HOLDER

BACKGROUND OF THE INVENTION

This invention relates to electric lamps and, in particular, to a holder for an amalgam in a gas discharge lamp.

Maintaining mercury vapor pressure equilibrium within a gas discharge lamp such as a fluorescent lamp is necessary to maintain optimum lumen output during extended lamp on periods. In conventional fluorescent lamps, the mercury vapor pressure increases to an optimum pressure allowing the lamp to reach maximum lumen output. As time passes, the mercury vapor pressure increases to a level above the most preferable pressure causing the luminous flux to decrease.

To help maintain the pressure at the optimum pressure, amalgams are introduced to maintain the mercury vapor pressure within an optimal range during lamp operation. Upon lamp ignition, the amalgam is heated which causes mercury to diffuse out of the solid and is released into the lamp as vapor. The amalgam achieves mercury vapor equilibrium during lamp operation by supplying the same amount of mercury atoms to the interior of the lamp envelope as are spent. However, when the lamp is switched off, the decrease in temperature causes the mercury vapor to navigate to and diffuse into the amalgam causing mercury starvation. The lack of mercury vapor in the lamp envelope during off periods results in low lumens at lamp startup. In order to obtain peak lumens upon lamp ignition without any startup time penalty, an adequate dose of mercury vapor is required to remain in the lamp envelope during lamp off periods.

A restricted fixed orifice in an amalgam capsule can be used to reduce the starvation effect for short off times. U.S. Pat. No. 5,828,169 uses such a technique. However, during extended off times, virtually all of the mercury can still return to the amalgam.

SUMMARY OF THE INVENTION

An amalgam holder for a discharge lamp having an exhaust tube and a flare pinched about the tube where the holder includes an extension of the tube or flare having a cavity for an amalgam, the cavity having a mouth; and a cover for the mouth, the cover being thermally actuated.

DESCRIPTION OF THE PREFERRED EMBODIMENTS

Figure 1:
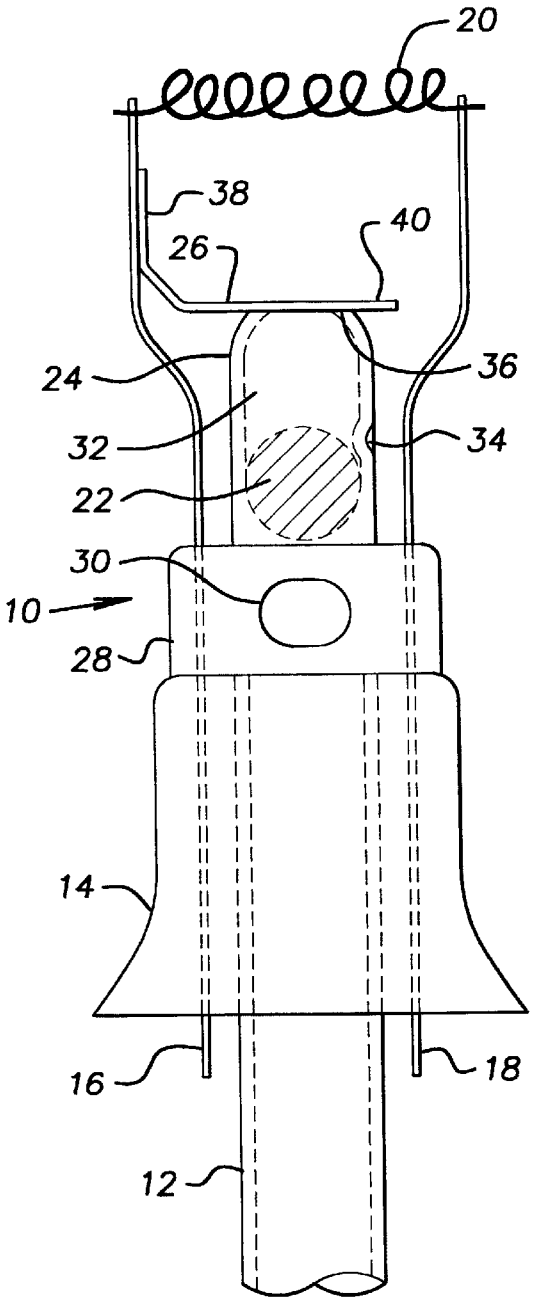
FIG. 1 is a plan view of an amalgam holder according to the invention.

Referring to FIG. 1, an amalgam holder 10 for a gas discharge lamp such as a fluorescent lamp includes an exhaust tube 12, a flare 14, two lead wires 16, 18, a cathode 20 between the lead wires 16, 18, an amalgam 22, an extension 24 and a cover or valve 26. The exhaust tube 12, the flare 14, the extension 24 may be formed, for example, from glass or a glass-like material. The leads 16, 18 and the cathode 20 are electrically conductive materials well-known in the art. The amalgam 22 is a metallic amalgam of, for example, mercury and other materials known in the art to be suitable for establishing a mercury (or other metallic ion) equilibrium during operation of a discharge lamp.

Typically, the flare 14 is pinched over the leads 16, 18 and the exhaust tube 12 while the material of the flare and tube are in a softened state. The area where the flare 14 is pinched is called the pinch 28. The pinch 28 typically includes a vent 30 in communication with the interior of the exhaust tube 12. A discharge lamp typically has a tubular envelope (not shown) that is closed at the end by inserting the flare 14 into the envelope cathode-first and sealing the flare 14 to the envelope.

The extension 24 can be advantageously formed from an extended portion of the tube 12 or it may be formed as an extension of the flare 14. If desired, the extension 24 could be formed from a separate piece of material. After pinching, there is little apparent difference.

The extension 24 may be, for example, generally cylindrical with a generally cylindrical cavity 32 within. The amalgam 22 may be retained within the cavity 32 by a dimple 34, or the like, in the wall of the extension 24. The mouth 36 of the cavity 32 may also be narrowed to constrict mercury vapor flow and to allow more efficient covering of the mouth 36 with the cover 26.

Figure 2:
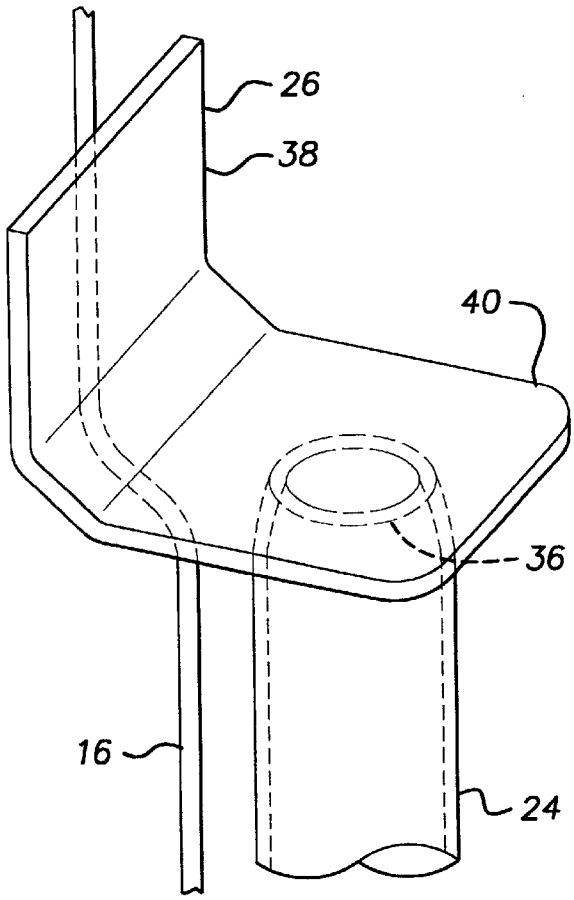
FIG. 2 is a perspective view of a detail of the holder of FIG. 1.

Referring also to FIG. 2, the cover 26 is a generally L-shaped piece of bimetal having a mounting portion 38 and a cover portion 40. The mounting portion 38 is attached to the lead wire 16 by, for example, welding. The cover portion 40 closes the mouth 36 when the cover 26 is cold. During operation of the lamp, the cover 26 is heated and the cover portion 40 lifts off of the mouth 36, thereby opening the cavity 32 to the atmosphere inside the envelope. The cover 26 thus operates as a thermally actuated valve.

When the lamp is at full operating temperature, the cover 26 has been heated by the cathode 20 and is open and the amalgam 22 establishes a desired mercury equilibrium inside the envelope. When the lamp is turned off, the cover 26 closes off the amalgam 22 from the atmosphere of the envelope thereby preventing the mercury in the envelope atmosphere from recombining with the amalgam 22. In this way, sufficient mercury remains in the envelope atmosphere to prevent mercury starvation during lamp startup.

While the cover 26 in the preferred embodiment is heat actuated using a bimetallic element, it would also be possible to actuate the cover 26 with electrical, chemical, or other motive techniques.

Figure 3:
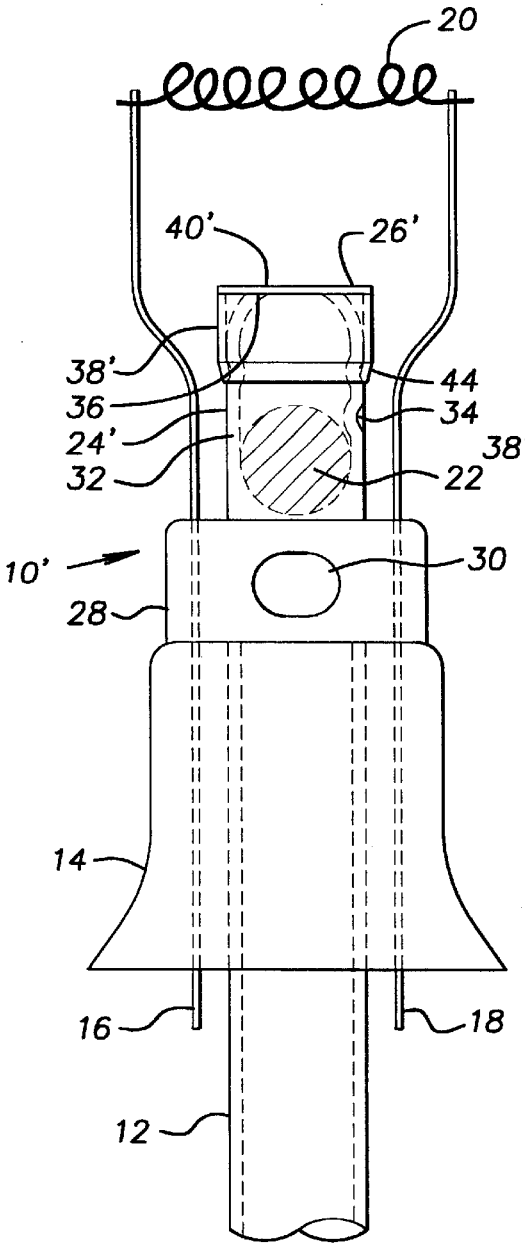
FIG. 3 is a plan view of an amalgam holder according to an additional embodiment of the invention.
Figure 4:
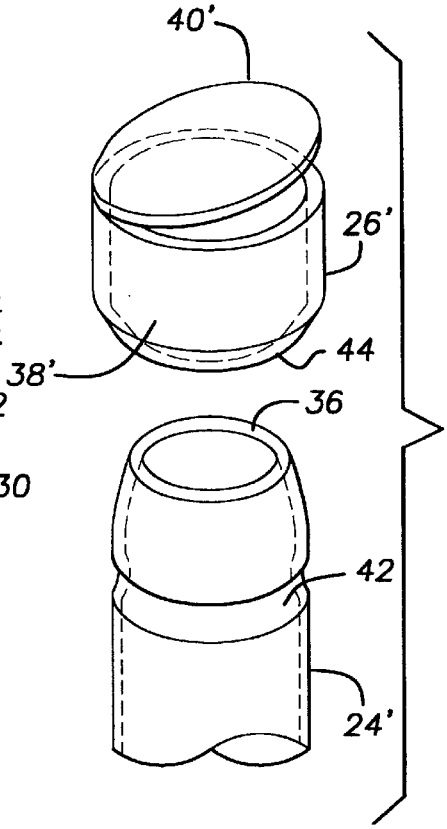
FIG. 4 is a perspective view of a detail of the holder of FIG. 3.

Referring to FIGS. 3 and 4, an additional embodiment of an amalgam holder 10' includes many of the previously described elements and operates in a similar manner. The bimetal cover 26' includes a mounting portion 38' and a cover portion 40'. The mounting portion 38' is a generally cylindrical sleeve and the cover portion 40' is a flap attached to the mouth end of the sleeve. The extension 24' includes a rolled in groove 42 to assist in retaining the cover 26' by engaging an annular lip 44 inside the mounting portion 38'.

Similar to the previous embodiment, the cover portion 40' closes the mouth 36 when the cover 26' is cold. During operation of the lamp, the cover 26' is heated and the cover portion 40' lifts off of the mouth 36, thereby opening the cavity 32 to the atmosphere inside the envelope. The cover 26' thus operates as a thermally actuated valve.

Figure 5:
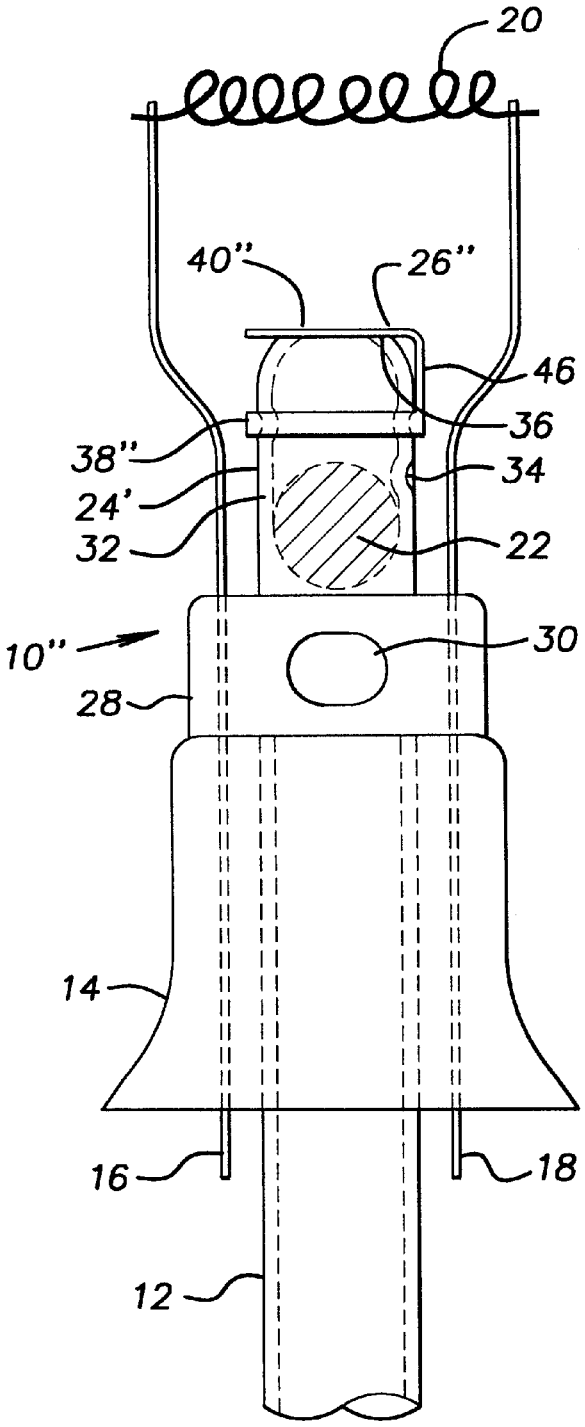
FIG. 5 is a plan view of an amalgam holder according to another embodiment of the invention.
Figure 6:
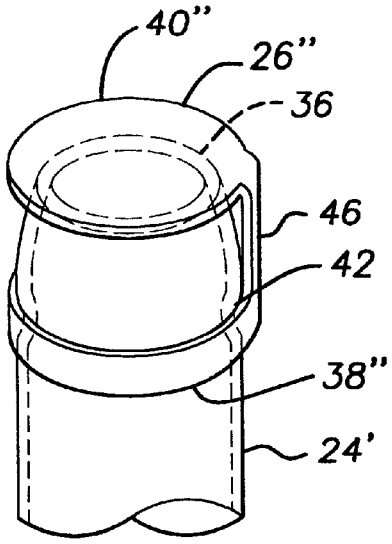
FIG. 6 is a perspective view of a detail of the holder of FIG. 5.

Referring to FIGS. 5 and 6, an additional embodiment of an amalgam holder 10" includes many of the previously described elements and operates in a similar manner. The bimetal cover 26" includes a mounting portion 38", a cover portion 40" and a strip portion 46. The mounting portion 38" is a band seated in the groove 42 and the cover portion 40" is a flap connected to the mounting portion 38" by the strip portion 46. If the strip portion 46 is considered to be a remaining portion of a cylindrical sleeve, it would represent between 1 and 10 degrees of the sleeve, with 5 degrees being preferred.

Similar to the previous embodiment, the cover 40" closes the mouth 36 when the cover 26" is cold. During operation of the lamp, the cover 26" is heated and the cover portion 40" lifts off of the mouth 36, thereby opening the cavity 32 to the atmosphere inside the envelope. The cover 26" thus operates as a thermally actuated valve.

It should be noted that the embodiments of FIGS. 3, 4, 5 and 6 each have a mounting portion that clasps the extension. While these embodiments completely encircle the extension, it is also possible to clasp the extension with embodiments that do not entirely encircle the extension. For example, if the mounting portion encircles greater than half of the circumference of the extension, the extension will still be clasped by the mounting portion.

Figure 7:
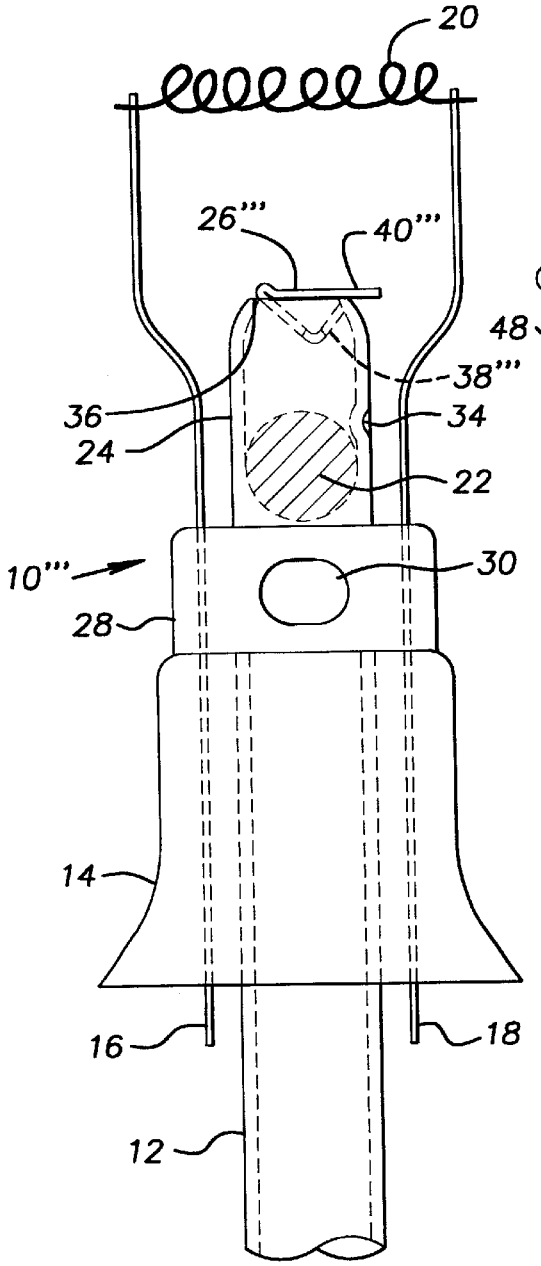
FIG. 7 is a plan view of an amalgam holder according to still another embodiment of the invention.
Figure 8:
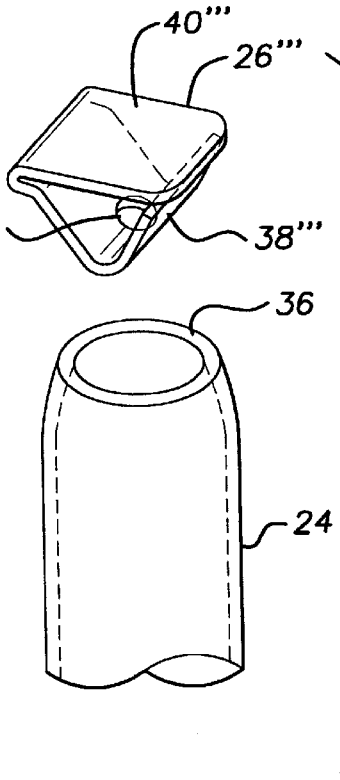
FIG. 8 is a perspective view of a detail of the holder of FIG. 7.

Referring to FIGS. 7 and 8, an additional embodiment of an amalgam holder 10'" includes many of the previously described elements and operates in a similar manner. The bimetal cover 26'" includes a mounting portion 38'" and a cover portion 40'". The mounting portion 38'" is a V-shaped member that compresses when inserted in the mouth 36 and then expands to retain the cover 26'" on the extension 24. The mounting portion 38'" includes an aperture 48 to minimize the blocking of the mouth 36 with the mounting portion 38'". The cover portion 40'" is a flap attached to the top of one leg of the V of the mounting portion 26'".

Similar to the previous embodiments, the cover portion 40'" closes the mouth 36 when the cover 26'" is cold. During operation of the lamp, the cover 26'" is heated and the cover portion 40'" lifts off of the mouth 36, thereby opening the cavity 32 to the atmosphere inside the envelope. The cover 26'" thus operates as a thermally actuated valve.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed:

1. An amalgam holder for a discharge lamp having an exhaust tube and a flare pinched about said tube, said holder comprising:

an extension of said tube or flare having a cavity for an amalgam, said cavity having a mouth; and a cover for said mouth, said cover being thermally actuated.

2. A holder according to claim 1, further comprising a lead wire pinched in said flare, said cover being a bimetallic valve having a mounting portion and a cover portion, said mounting portion being attached to said lead wire and said cover portion movably covering said mouth.

3. A holder according to claim 1, wherein said cover comprises a bimetallic valve, said valve having a mounting portion and a cover portion, said mounting portion clasping said extension and said cover portion movably covering said mouth.

4. A holder according to claim 3, wherein said mounting portion is a generally cylindrical sleeve about said extension, said sleeve having a mouth end, and said cover portion is a flap attached to said sleeve at said mouth end.

5. A holder according to claim 3, wherein said valve further comprises a strip portion and said mounting portion is a band about said extension and said cover portion is a flap, said band being connected to said flap by said strip portion.

6. A holder according to claim 1, wherein said cover comprises a bimetallic valve, said valve having a mounting portion and a cover portion, said mounting portion being retained within said extension and said cover portion movably covering said mouth.

* * * * *